United States Patent [19]

Ball et al.

[11] Patent Number: 4,827,629

[45] Date of Patent: May 9, 1989

[54] DRYING OF CLAYWARE

[75] Inventors: Kenneth J. Ball, Newcastle; Brian Stanistreet, Burslem, both of United Kingdom

[73] Assignee: Thermic Designs Limited, England, England

[21] Appl. No.: 41,847

[22] Filed: Apr. 23, 1987

[30] Foreign Application Priority Data

Apr. 24, 1986 [GB] United Kingdom ..... 8610284

[51] Int. Cl.[4] ..... F26B 25/00

[52] U.S. Cl. ..... 34/104; 34/68

[58] Field of Search ..... 34/104, 105, 21, 54, 34/68

[56] References Cited

U.S. PATENT DOCUMENTS

| | | | |
|---|---|---|---|
| 832,473 | 10/1906 | Fromont | 34/104 |
| 2,666,270 | 1/1954 | Blanchard | 34/104 |
| 4,285,141 | 8/1981 | Wedgwood | 34/104 |

FOREIGN PATENT DOCUMENTS

| | | | |
|---|---|---|---|
| 123769 | 10/1919 | United Kingdom | 34/104 |

*Primary Examiner*—Henry A. Bennet

*Attorney, Agent, or Firm*—W. Thad Adams, III

[57] ABSTRACT

A dryer for articles of sanitary ware comprises a sealable chamber (12) in which each cast clay article (10) is located in position below a tube (14) and between slots (16) at floor level, dampers (18) being provided for the slots (16). During a first drying phase of some one to two hours after demoulding, the articles (10) are subjected to space drying by gentle movement of heated air passing into the chamber (12) through openings (26). At the end of the first phase of initial general conditioning, the tubes (14) are positioned to extend internally of the articles (10), and the dampers (18) allow heated air to pass into the chamber (12) through the slots (16). Suction is applied to the tubes (14) so that the heated air is drawn from the slots (16) across the external and subsequently internal surfaces of the articles (10) into the tubes (14). This causes articles to dry evenly, thoroughly, and quickly without distortion or cracking.

6 Claims, 1 Drawing Sheet

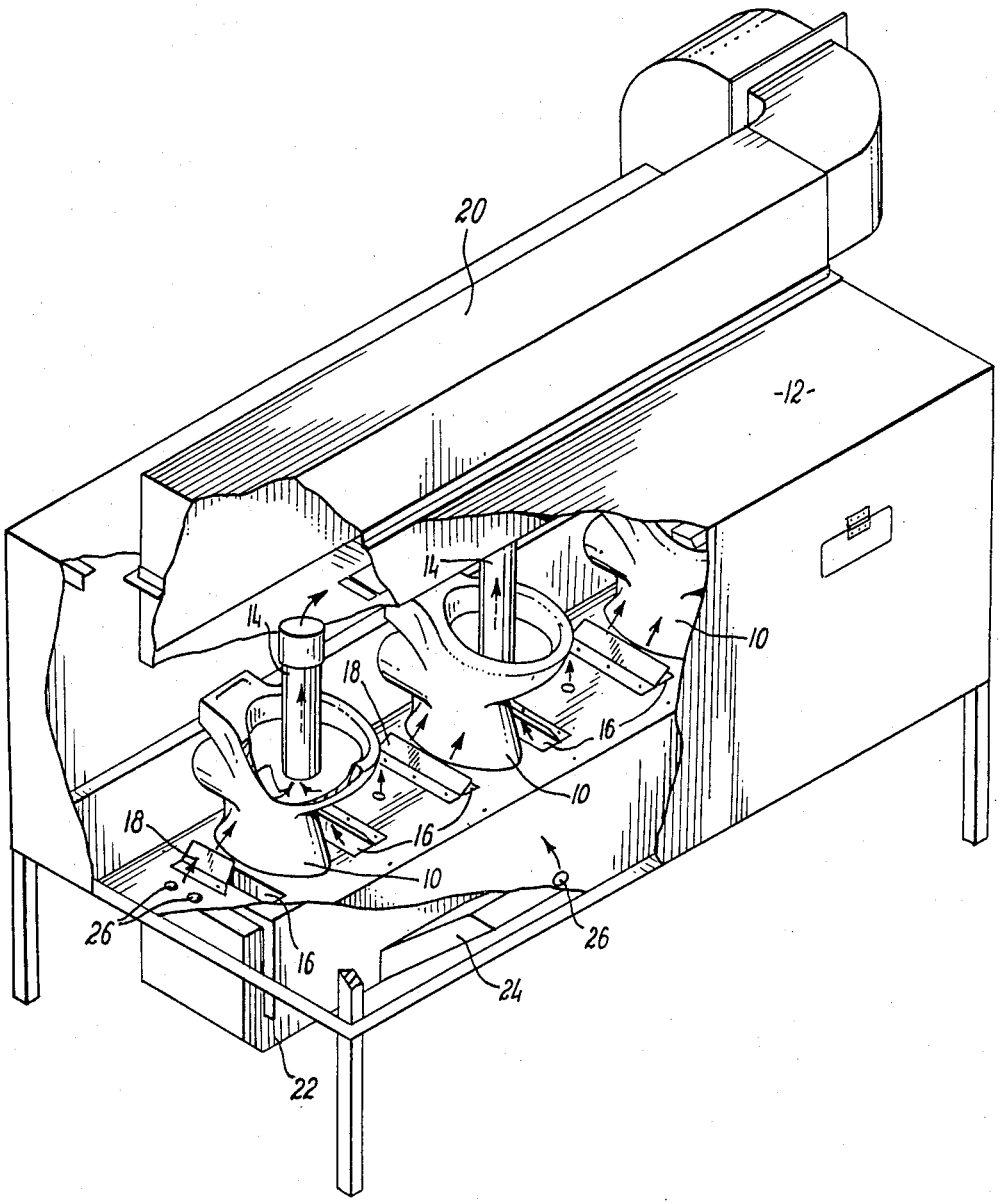
20
-12-
14
14
10
18
16
10
18
16
10
26
16
26
24
22

DRYING OF CLAYWARE

This invention relates to a method of and apparatus for drying clayware, particularly cast sanitary clayware articles.

At the present time articles of sanitary ware after casting generally remain within the production area for periods varying between 24 hours to 48 hours, although sometimes for up to 4 days. During such a period, the articles are dried within the general environment of the production area to a condition when dry settling can be carried out prior to spray glazing, or alternatively the articles can be wet fettled in situ and transferred to a final dryer remote from the production area. Also articles are on occasion covered during a first overnight period to retard drying and to allow wet fettling the day following casting.

Drying in a production area has heretofore been carried out by providing steam heating coils under casting benches supporting the ware, and occasionally this heat is supplemented by roof supported ceiling fans which provide air movement. However more up to date methods comprise air drying for both the ware and the moulds, the working environment during the day working period being conditioned for operator comfort and part-drying, and the space temperatures being elevated during the overnight period for more concentrated drying.

With such conventional methods it is possible that the process from casting to despatch ex-factory of the finished article can take a period of one week or more mainly due to the slow drying process.

According to the present invention there is provided apparatus for drying clayware, the apparatus comprising a closable chamber, first inlet means for admitting a moving heated gaseous medium into the chamber whereby the ware can be dried during a first period of time by way of space drying, further inlet means comprising a pair of inlets spaced apart to enable the ware to be located therebetween and adjacent to each one thereof, and means for selectively supplying a heated gaseous medium through the inlets, whereby localised drying of the ware can take place during a second period of time with a heated gaseous medium being directed along a path extending generally across exterior and interior faces of the ware.

Preferably outlet means is locatable internally of the ware for removal of the heated gaseous medium. The outlet means may comprise a tubular component which may be adjustable in position to locate internally of the ware after the latter has been positioned thereunder, and means may be provided for applying suction to the tubular component for removal of the gaseous medium.

An embodiment of the present invention will now be described by way of example only, with reference to the accompanying drawing which is a perspective view of apparatus according to the invention with part removed to view internally.

Referring to the drawing, articles 10 of sanitaryware can be produced by casting in a conventional plaster mould or by a pressure casting technique.

After casting in and removal from the plaster mould, the cast clay article is transferred by a trolley, handling device, or manually from a casting bench into a drying chamber 12 situated local to the casting bench. The clay articles 10, when loaded, are located at precise and known positions within the chamber 12.

When a ware piece is manufactured by pressure casting, the article 10 is automatically or manually loaded, on 'setters' or open pallets, onto a conveyor system which transports the ware to a front face of the drying chamber 12. An automatic pusher mechanism discharges pallets one at a time onto an indexing conveyor built into the base of the drying chamber. The dryer conveyor continues to operate, at a speed compatible with the speed of pressing, until the chamber 12 is fully loaded. The capacity and, therefore, the number of pallets which the fully loaded dryer will accept, is variable and depends upon customer requirements. For side loading, a gravity roller conveyor can be incorporated at each loading position to assist transfer of ware into the dryer.

Each article 10 is located within the drying chamber 12 precisely in position below a tube or nozzle 14 and between slots 16 at floor level at respective sides of the article 10.

Dampers 18 within the chamber 12, which are automatically operated and interlinked, can selectively direct air into the chamber 12 to discharge through the slots 16 adjacent to each article 10, and suction can be applied to the tube or nozzle 14, the latter communicating with an outlet duct 20 in a top wall of the chamber 12.

Once the chamber 12 is fully laden, doors thereof (not shown), preferably of the vertical lift type, are either manually or automatically closed to form a sealed environment within the chamber.

During a first phase of 1 to 2 hours after demoulding, each article 10 in the chamber 12 is subjected to space drying by means of heated air with controlled humidity level delivered from a mains supply duct 22 and side ducts 24 below a lower wall of the chamber 12 through lower wall openings 26, the air moving within the chamber 12. The dampers 18 in the first phase close the slots 16. In the first phase the articles 10 are subjected to only gentle air movement and closely controlled rates of temperature climb and humidity level, to enable the articles 10 to gain sufficient structural strength prior to more concentrated drying. This initial period after demoulding is critical to a clay article as damage can easily occur if subjected to a high velocity air movement, high temperatures or low relative humidity levels.

After the initial general conditioning, the articles 10 are hardened sufficiently to be able to be subjected to rigorous localised drying. The tubes or nozzles 14 are automatically positioned to extend internally of the respective articles 10, and the dampers 18 are operated to direct the heated air through the slots 16. Suction is applied to the tubes or nozzles 14, and the heated air is drawn from the inlet slots 16 across the external surfaces of the articles 10 and subsequently across the internal surfaces of the articles 10 into the tubes or nozzles 14 and the duct 20. This ensures that all surfaces of the articles 10 are subjected to the highly directional air flows and causes the articles to dry evenly, thoroughly and quickly without distortion or cracking. The position of the tubes or nozzles 14 is variable depending on the type of article, and creates variable air speeds according to the distance the tubes or nozzles 14 extend into the articles 10.

The dryer can be constructed in a modular form to reduce site installation to a minimum. A basic framework of the dryer may be formed from rectangular hollow steel sections of webbed and bolted construction, the top and side walls preferably being manufactured using double-skin and insulated steel panels. The doors may be heavily sealed to prevent air spillage and can have a similar construction to that of the walls. Areas of internal surfaces exposed to humid air flows are preferably formed from non-corrosive materials.

The dryer can be supplied as a single module or can be supplied as a bank of several units for greater production rates. Further, the dryer can be operated as a continuous tunnel-type.

The described method of drying a sanitary ware articles enables production from raw material processing to warehouse despatch to be accomplished within a 24 hour period, the drying being performed within a maximum period of 6 hours for complex pieces of ware and 3 hours for smaller, standard pieces, as compared with the minimum period of 24 hours in present drying methods.

Various modificiations may be made without departing from the invention.

We claim:

1. Apparatus for drying clayware, the apparatus comprising a closable chamber, first inlet means for admitting a moving heated gaseous medium into the chamber whereby the ware can be dried during a first period of time by way of space drying, further inlet means comprising a pair of inlets spaced apart to enable the ware to be located therebetween and adjacent to each one thereof, and means for selectively supplying a heated gaseous medium through the inlets, whereby localised drying of the ware can take place during a second period of time with a heated gaseous medium being directed along a path extending generally across exterior and interior faces of the ware.

2. Apparatus according to claim 1, wherein outlet means is locatable internally of the ware for removal of the heated gaseous medium.

3. Apparatus according to claim 1 or 2, wherein each of the inlets comprises an opening in a wall of the chamber, which opening is closable by a damper.

4. Apparatus according to claim 2, wherein the outlet means comprises a tubular component which is adjustable in position to locate internally of the ware after the latter has been positioned thereunder.

5. Apparatus according to claim 4, wherein means is provided for applying suction to the tubular component for removal of the gaseous medium.

6. Apparatus according to claim 1, wherein a conveyor is provided in the chamber to move a plurality of ware pieces to respective drying positions within the chamber.

* * * * *